US005311752A

United States Patent [19]

Gille

[11] Patent Number: 5,311,752

[45] Date of Patent: May 17, 1994

[54] WARP KNITTING MACHINE WITH ELECTRICALLY CONTROLLED THREAD FEED

[75] Inventor: Friedrich Gille, Obertshausen, Fed. Rep. of Germany

[73] Assignee: Karl Mayer Textilmaschinenfabrik GmbH, Obertshausen, Fed. Rep. of Germany

[21] Appl. No.: 60,304

[22] Filed: May 10, 1993

[30] Foreign Application Priority Data

May 13, 1992 [DE] Fed. Rep. of Germany ..... 4215691

[51] Int. Cl.[5] ..... D04B 23/00; G06F 15/46

[52] U.S. Cl. ..... 66/207; 66/203; 364/470; 307/66; 318/41

[58] Field of Search ..... 66/203, 204, 207, 157, 66/165; 364/470, 167.01; 318/41, 51; 192/1.43, 1.48, 1.49, 1.50, 1.52, 1.53, 1.55, 8 R, 144; 307/64, 66

[56] References Cited

U.S. PATENT DOCUMENTS

| | | | |
|---|---|---|---|
| 4,298,107 | 11/1981 | Schmitz et al. | 192/144 X |
| 4,387,579 | 6/1983 | Branke et al. | 66/157 |
| 4,703,191 | 10/1987 | Ferguson | 307/66 X |
| 4,914,566 | 4/1990 | Steutermann | 364/167.01 |
| 5,113,123 | 5/1992 | Noser et al. | 307/66 X |
| 5,144,153 | 9/1992 | Scheppmann, II | 307/66 |

FOREIGN PATENT DOCUMENTS

| | | | |
|---|---|---|---|
| 10160367 | 9/1988 | European Pat. Off. . | |
| 2349931 | 9/1974 | Fed. Rep. of Germany | 66/204 |

OTHER PUBLICATIONS

"Wirkerei-und Strickerei-Technik", Nov. 1967, pp. 504-602.

"Electronic" Mar. 1991, pp. 54-59 Apr. 1991, pp. 74-77.

*Primary Examiner*—Andrew M. Falk
*Assistant Examiner*—John J. Calvert
*Attorney, Agent, or Firm*—Omri M. Behr; Matthew J. McDonald

[57] ABSTRACT

A warp knitting machine comprises a brake operative upon current interruption. The guide bars are displaced by an electrical setting motor as well as a control arrangement, which establishes the position of the guide bars in dependence upon the angular position of the main shaft. The control arrangement bases its control upon a predetermined displacement function relating the positions of the main shaft and guide bar. The setting motor and control arrangement are connected to a main power source via an intermediate circuit, which has at least one storage condenser. This machine allows for a rather rapid change of the lapping pattern and a continuance of controlled guide bar displacement right up to the standstill of the main shaft.

9 Claims, 1 Drawing Sheet

Fig.1
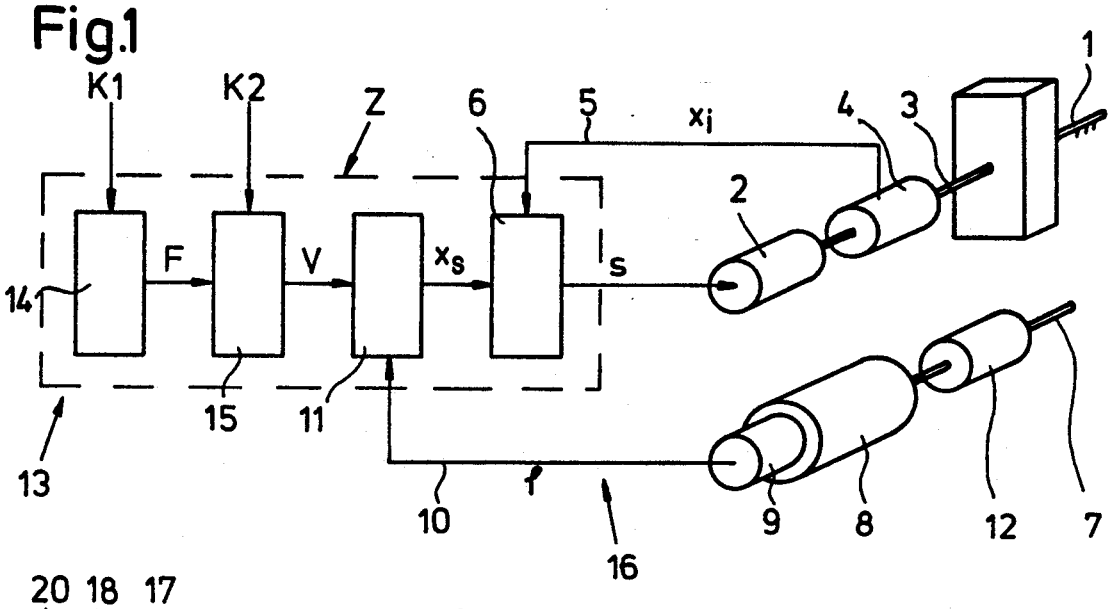
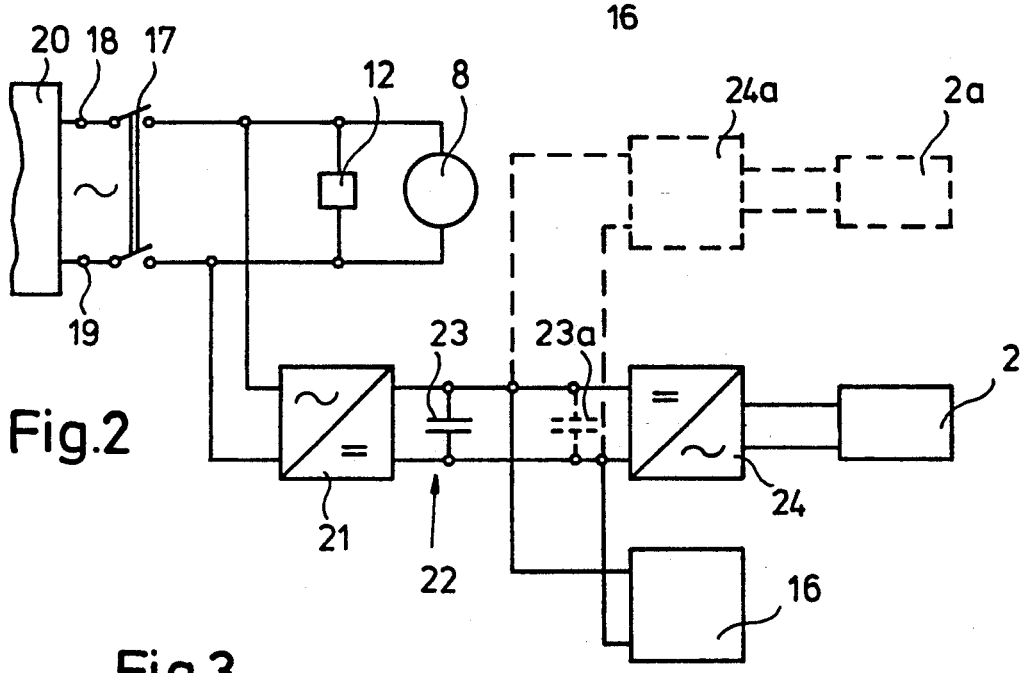
Fig.2
Fig.3
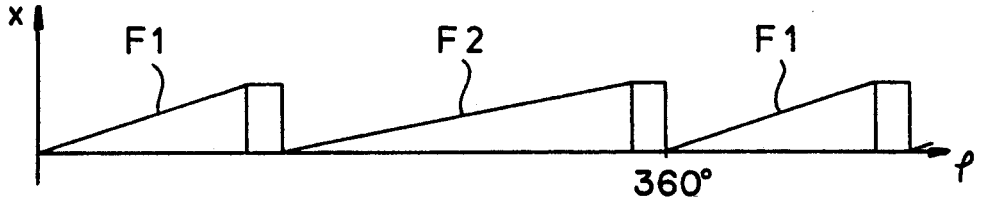
Fig.4
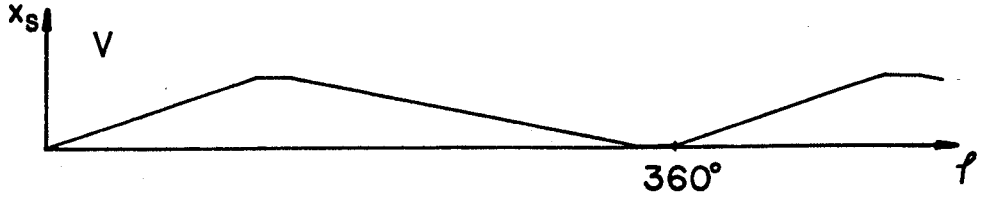

WARP KNITTING MACHINE WITH ELECTRICALLY CONTROLLED THREAD FEED

BACKGROUND OF THE INVENTION

1. Field Of the Invention

The present invention relates warp knitting machines having (a) a main shaft driven by an electrical main motor, (b) an electrically operated brake activated upon current interruption, and (c) at least one supplemental electrical system connected to the main power circuit, for influencing the thread feed.

2. Description Of Related Art

When a warp knitting machine of the foregoing type (DE PS 30 25 792) is switched, the supplemental control system is separated from the power mains by a time delay relay, so that the supplemental system operates until the actual standstill of the main shaft. However, if power mains fail both the main shaft motor as well as the supplemental system lose power. While inertia causes the main shaft to runs on, immediate inoperability befalls the supplemental system, that is, the controlling motor for the warp beam drive speed and a jacquard arrangement. The main shaft is not considered a substantial problem since the brake on the main shaft operates quite rapidly, that is, within one or two revolutions. The thus resulting pattern errors are not observable to the naked eye.

Generally speaking, guide bars are mechanically connected to the main shaft, suitably by means of a cam plate system or pattern chains. Thus, after the run down of the main shaft, the correct correspondence between the guides and the remaining operating elements remains. It is however, burdensome to alter such displacement patterns since this requires an exchange of cam plates or pattern chains. It is thus either impossible or rather difficult to provide a displacement pattern with a longer repeat.

A control arrangement for the displacement of guide bars in warp knitting machines is known (DE OS 22 57 224), in which the displacement steps to be taken are read off from a schedule carrier, for example a punched or magnetic tape. A synchronizing transmitter generates a signal in particular angular positions of the main shaft, based on which, the most recently read displacement step is carried out by means of a position control circuit. By using another schedule carrier, it is possible to change the pattern by changing the displacement motion. The progress of the displacement motion cannot be controlled since it depends upon the design of the control circuit.

Accordingly, there is a need for a warp knitting machine of the above-mentioned type in which the displacement pattern for the guide bars may be altered in a simple and procedurally safe manner.

SUMMARY OF THE INVENTION

In accordance with the illustrative embodiments demonstrating features and advantages of the present invention, there is provided a warp knitting machine adapted to be connected to a main power source. The machine has at least one guide bar, a main shaft, and an electrical main motor coupled to the main shaft for driving it. A brake coupled to the main shaft can brake it upon interruption of current to the electrical main motor. Included is at least one supplemental system for influencing delivery of threads. This supplemental system is commonly powered with the main motor by the main power source. The supplemental system has a control arrangement, an intermediate circuit, and at least one electrical setting motor for displacing the guide bar. The control arrangement is coupled to the main shaft and the setting motor. This control arrangement is responsive to the angular position of the main shaft for positioning the guide bar, as determined by a predetermined displacement function correlating positions of the guide and the main shaft. The intermediate circuit has an energy storage device for replacing interrupted power from the main power source to keep the setting motor and the control arrangement powered at least temporarily.

The preferred supplemental system has an electrical setting motor for displacing the guide bar. The preferred control arrangement sets the position of the guide bars in dependence upon the angular position of the main shaft, using a predetermined displacement function. This preferred control arrangement is connected to the power mains via at least one storage condenser.

In such a construction, the guide bar displacement depends up on the displacement function generated by the control arrangement. This can be readily altered and permits larger repeats without any difficulty. The displacement function is a continual function which, for every angular position of the main shaft, specifies a particular position of the guide bar. In normal operation therefore, the relative correspondence between the guides and the remaining elements of the machine are exactly defined.

Difficulties arise however, when a power interruption occurs in the power mains, since the control arrangement and the setting motor are no longer operative. Thus collisions between the operating elements cannot be avoided. However, by utilizing a power restoring condenser, the time up to the standstill of the main shaft can be bridged. Since the main shaft is braked and therefore the electrical power need only be available for a short time, the cost and space requirement for a storage condenser is not too great. The provision of the storage condenser in an intermediate circuit has the advantage that it is constantly charged fully and therefore unloading can commence at a predetermined voltage.

Preferably, when there is a plurality of guide bars with appropriate setting motors, the intermediate, power-restoring circuit is common to all the motors. This permits the total capacity of the storage condenser, that is to say, the storage condensers switched in parallel, to be smaller, since the peak demand of the storage motors generally speaking does not occur at the same time and therefore an energy exchange is possible.

Preferably, the main shaft motor and the setting motor are driven with alternating or cyclic current and the storage condenser in the intermediate circuit is located between a rectifier and an inverter. In such an arrangement the control condenser is safely charged even though in the rest of the circuit, the current is an alternating or cyclic current. Furthermore, this makes it simple to drive the setting motor with another frequency, suitably lower than that at the main shaft motor. Such adaptable frequency is of interest, with respect to the design and control of the setting motor.

Preferably, the setting motor is an electrical linear motor. This enables the guide bars to be controlled with greater accuracy.

In a preferred embodiment the control arrangement comprises: an absolute bar position transmitter, an absolute rotational angle transmitter for the main shaft, a schedule transmitter, and a position control circuit. The absolute bar position transmitter provides a different position signal for each position of the guide bar, that is, the setting motor. The absolute rotational angle transmitter provides a different rotational angle signal value for every position of angular rotation of the main shaft. The schedule transmitter receives different displacement functions to generate the appropriate position reference value, in dependence upon the rotational angle signal of the chosen displacement function. The position control circuit compares the bar position signal with a position target value and controls the setting motor in dependence upon the deviation from the desired value.

The use of an absolute rotational angle generator ensures a clear relationship between the bar's position target value and the rotational angle setting of the main shaft at every point in time. The absolute bar position transmitter ensures that a position signal is clearly assigned to each position target value. In summary, there is thus obtained an unequivocal relationship between a rotational angle setting and position. This relationship may be readily altered by the provision of a different displacement function.

BRIEF DESCRIPTION OF THE DRAWINGS

The present invention may be readily understood by reference to the drawings which illustrate as follows:

FIG. 1 is a block switching diagram of the novel portion of the warp knitting machine of the present invention.

FIG. 2 is a simplified electrical switching diagram.

FIG. 3 shows a graph of transition curves, and

FIG. 4 shows a displacement function generated by said transition curves.

DETAILED DESCRIPTION OF THE PREFERRED EMBODIMENTS

Referring to FIG. 1, guide bar 1, which is to be displaced, is connected via a connecting rod 3 to the setting motor 2, here in the form of an electrical linear motor. An absolute position transmitter 4 generates position signal $X_i$ which runs via line 5 to position controller 6. Transmitter 4 may be an encoder for producing a digitally encoded signal indicating displacement of bar 1.

The main shaft 7 of the warp knitting machine is driven by electrical motor 8. An rotational absolute angle generator 9 sends to the output arrangement 11 over line 10, a rotational angle signal, which corresponds to the appropriate position of the main shaft 7. Generator 9 may be a shaft encoder for sending a digitally encoded signal corresponding to shaft rotation. Arrangement 11, in dependence upon the rotational angle signal on line 10, transmits position target value X. to the position controller 6. In dependence upon the deviation from the desired path, the setting motor 2 is provided with the appropriate control signal S.

Furthermore, the main shaft 7 is provided with a brake 12 which is caused to operate when the current fails, by means of a power storage means, for example a loaded spring (not shown). When current is applied a solenoid (not shown) can overcome the spring and allow shaft rotation.

A schedule transmitter 13 comprises a storage means 14 and a computer 15. Storage means 14 can be an EPROM or other type of digital memory. A plurality of prototype transition curves F for the overlap and the underlap displacements are stored in storage means 14. The desired transition curves for the desired lapping patterns can be identified and summoned by means of characteristic value K1.

Characteristic value K2 presents a calculation formula to computer 15 which operates in conjunction with the specified transition curves F. The formula instructions comprise, inter alia, the sign specification (positive/negative) and an integer multiplier. From these instructions, computer 15 assembles transition curves F in sequence, and optionally rescales and/or inverts them to produce the displacement function V. This in turn allows output arrangement 11 to generate the appropriate position target value $X_s$ as a function of the rotational angle signal on line 10.

In this way, there is a clear correspondence between the angular position of main shaft 7 and the appropriate position of guide bar 1. The guide bar is so positioned by the position controller 6 that it can run through its entire working cycle without the occurrence of collisions. For example, the control value S can be produced as a linear or other function of the difference between signals $X_i$ and $X_s$.

In practice, blocks 6, 11 and 15 as well as the storage means 14 need not be separate segments. In fact, they can suitably be put together in a central processing unit Z in the manner of a process computer. This processor can be programmed with interrupt handlers that respond to increments in signals on lines 5 and 10. When signal $X_i$ changes, signal $X_s$ is adjusted based on the feedback function in arrangement 6 (e.g., a linear or integral function of $(X_i - x_s)$). When the signal on line 10 changes signal X. is adjusted (e.g. by a look-up table formed in accordance with function F).

The CPU Z, together with the absolute position transmitter 4 and the absolute rotational angle position transmitter 9, form the control arrangement 16 for the displacement of guide bar 1.

FIG. 2 illustrates that the main shaft 8 is connected to an alternating current source 20 via dual pole switch 17 having contacts 18 and 19. A brake 12 is connected across the switched side of switch 17 in parallel with previously illustrated, main shaft motor 8, so that upon power failure, (for example main power interruption from source 20), brake 12 is activated and the main shaft is brought to a standstill, suitably in a few seconds.

A rectifier 21 is powered through the same switch 17 by alternating current power source 20. An intermediate circuit 22 having an energy storage device (condenser 23) is connected to the output of rectifier 21. Rectifier 21 may be a full or half wave bridge using in one embodiment a transformer feeding a rectifier bridge to charge condenser 23 (transformer and bridge not shown).

Connected to circuit 22 is an inverter 24, which is powered by condenser 23 to, in turn, power setting motor 2. Inverter 24 produces an alternating current to motor 2. Control arrangement 16 is also connected across condenser 23. Arrangement 16 and motor 2 respond to previously mentioned control signal S. In case it is necessary to power a second setting motor 2*a* for another guide bar, a further inverter 24*a* is connected to intermediate circuit 22. Additionally, intermediate circuit 22 is provided with additional condenser 23*a*; or a larger condenser 23 is provided. Where control arrangement 16 is driven by DC current, it may be directly connected to the intermediate circuit.

The capacity of intermediate circuit 22 is so chosen that control arrangement 16 and setting motor 22 can unequivocally be operated up to the time of complete standstill of the main shaft. One must take into account the fact that only a partial discharge of the storage condenser 23 is permissible since otherwise the condenser size is inadequate for driving the control arrangement 16 and the setting motor 2. Generally speaking, a 50% discharge is permissible.

FIG. 3 illustrates individual transition curves F1 for the overlap and F2 for the underlap as they are stored in storage means 14. The computer 15 can assemble them in sequence to provide the displacement function V, which is illustrated in FIG. 4. In this simple case, the computation operation defined by characteristic K2 involves inverting the control curve F2 in the computation. The transition curves are clearly shown providing a displacement of one needle space. For displacements over a plurality of needle spaces, one may utilize the same transition curves, however in such a case computer 15 must multiply the displacement values by an integer defined by characteristic K2.

The transition curves herein are illustrated as straight lines. In practice however, the curves are rather specialized curves, which are similar to a sinusoidal, parabolic or hyperbolic format or are comprised of a plurality of collected segments. The purpose is to keep the accelerations and decelerations of the guide bar 1 to an absolute minimum. The displacement functions can also take into account other displacement errors such as those caused by the utilization of a linked push rod in the guide bar drive or by a needle/guide deflection due to the tension of the threads.

In the illustrated example, brake 12 is operated not only when a power failure occurs in the main source 20, but also when switch 17 is opened. If it is undesirable for the brake to operate in such a case, the brake can be connected before switch 17 so that the switched off main motor 8 still continues to run. In this case, the capacity of the storage means in the intermediate circuit 22 is insufficient unless power be removed from the main circuit by a timed delay as is the case in other systems, such as are described in DE PS 30 25 782.

Instead of alternating current, it is also possible to utilize a multi-phase or other pulsing or cyclic current source.

I claim:

1. A warp knitting machine adapted to be connected to a main power source, comprising:

at least one guide bar;

a main shaft;

an electrical main motor coupled to said main shaft for driving the shaft;

braking means coupled to said main shaft for braking the shaft upon interruption of current to said electrical main motor; and at least one supplemental system for influencing delivery of threads, said supplemental system being commonly powered with said main motor by said main power source, said supplemental system comprising:

(a) at least one electrical setting motor for displacing said guide bar, (b) a control arrangement coupled to said main shaft and said setting motor and responsive to the angular position of the main shaft for positioning said guide bar as determined by a predetermined displacement function correlating positions of said guide and said main shaft, and (c) an intermediate circuit having an energy storage device for replacing interrupted power from said main power source to keep said setting motor and said control arrangement powered at least temporarily.

2. A warp knitting machine in accordance with claim 1 wherein said intermediate circuit comprises:

at least one storage condenser adapted to be charged by said main power source.

3. A warp knitting machine in accordance with claim 1 wherein said at least one guide bar comprises a plurality of guide bars, and wherein said at least one setting motor comprises a plurality of setting motors for controlling a different corresponding one of said guide bars, said setting motors being coupled to said intermediate circuit to be powered thereby at least temporarily.

4. A warp knitting machine in accordance with claim 2 wherein said main power source supplies alternating current to said main motor and the setting motors, said machine comprising:

a rectifier adapted to be coupled to said main power source for charging said condenser; and an inverter coupled to said condenser to be powered by it.

5. A warp knitting machine in accordance with claim 4 wherein the setting motor comprises a linear electrical motor.

6. A warp knitting machine in accordance with claim 1 wherein the setting motor comprises a linear electrical motor.

7. A warp knitting machine in accordance with claim 6 wherein the control arrangement comprises:

a) an absolute bar position transmitter for generating a unique bar position signal for varying positions of the guide bar, b) an absolute rotational angle transmitter for providing a unique rotational angle signal in response to varying angular positions of said main shaft, c) a schedule transmitter for providing position target signals in response to the rotational angle signal, said schedule transmitter being adapted to receive a displacement function for specifying said position target signals as a function of said rotational angle signals, and d) a position control circuit for controlling the setting motor based on a comparison of said bar position signal with the position target signal.

8. A warp knitting machine in accordance with claim 1 wherein the control arrangement comprises:

a) an absolute bar position transmitter for generating a unique bar position signal for varying positions of the guide bar, b) an absolute rotational angle transmitter for providing a unique rotational angle signal in response to varying angular positions of said main shaft, c) a schedule transmitter for providing position target signals in response to the rotational angle signal, said schedule transmitter being adapted to receive a displacement function for specifying said position target signals as a function of said rotational angle signals, and d) a position control circuit for controlling the setting motor based on a comparison of said bar position signal with the position target signal.

9. A warp knitting machine in accordance with claim 4 wherein the control arrangement comprises:

a) an absolute bar position transmitter for generating a unique bar position signal for varying positions of the guide bar, b) an absolute rotational angle transmitter for providing a unique rotational angle signal in response to varying angular positions of said main shaft, c) a schedule transmitter for providing position target signals in response to the rotational angle signal, said schedule transmitter being adapted to receive a displacement function for specifying said position target signals as a function of said rotational angle signals, and d) a position control circuit for controlling the setting motor based on a comparison of said bar position signal with the position target signal.

* * * * *